US010098463B1

(12) United States Patent
Cheng

(10) Patent No.: US 10,098,463 B1
(45) Date of Patent: Oct. 16, 2018

(54) ERGONOMIC SEAT CUSHION

(71) Applicant: Peggy Cheng, Ashland, OR (US)

(72) Inventor: Peggy Cheng, Ashland, OR (US)

( * ) Notice: Subject to any disclaimer, the term of this patent is extended or adjusted under 35 U.S.C. 154(b) by 112 days.

(21) Appl. No.: 15/370,080

(22) Filed: Dec. 6, 2016

(51) Int. Cl.
*A47C 7/02* (2006.01)
*A47C 7/18* (2006.01)
*B68G 7/00* (2006.01)

(52) U.S. Cl.
CPC ..... *A47C 7/022* (2013.01); *A47C 7/18* (2013.01); *B68G 7/00* (2013.01)

(58) Field of Classification Search
CPC ..... A47C 7/022; A47C 7/18; B68G 7/00
See application file for complete search history.

(56) References Cited

U.S. PATENT DOCUMENTS 1,468,072 A * 9/1923 Ogle ..... A47C 7/021 128/889
1,595,698 A * 8/1926 Wilson ..... A47C 20/027 5/630
2,216,818 A * 10/1940 Kuhlman ..... A47C 7/021 297/461
2,552,476 A * 5/1951 Barton ..... A47C 7/021 297/452.22
2,659,418 A * 11/1953 Berman ..... A47C 7/021 267/145
2,785,419 A * 3/1957 Walker ..... A61G 7/05723 5/630
2,819,712 A * 1/1958 Morrison ..... A47C 4/54 297/DIG. 1
2,825,393 A * 3/1958 Warburton ..... A47C 7/022 267/103
2,933,738 A * 4/1960 Whelan ..... A47C 20/027 5/630
3,050,748 A * 8/1962 Deutinger ..... A47K 3/125 4/239
3,158,878 A * 12/1964 Pernell ..... A61G 7/05723 128/889
3,376,070 A * 4/1968 Johnson ..... A47C 7/022 249/194
3,503,649 A * 3/1970 Johnson ..... A47C 7/022 297/452.25
3,987,507 A * 10/1976 Hall ..... A47C 7/18 297/DIG. 1
4,132,228 A * 1/1979 Green ..... A47C 7/022 297/284.3
D250,985 S * 2/1979 Armstrong ..... D21/493
4,567,887 A * 2/1986 Couch, Jr. ..... A61F 5/34 128/118.1
D284,139 S * 6/1986 Ko ..... 5/630
(Continued)

*Primary Examiner* — James M Ference
(74) *Attorney, Agent, or Firm* — Kyle A. Fletcher, Esq.

(57) ABSTRACT

The ergonomic seat cushion is adapted to receive the buttocks and coccyx of a person in such a manner that a person sits comfortably for extended periods of time. The ergonomic seat cushion comprises a plurality of rings and an upholstery. The upholstery covers the plurality of rings. The location of the aperture within each ring selected from the plurality of rings suspends a body part selected from the group consisting of the left buttock, the right buttock, or the coccyx. This suspension relieves the selected body part from carrying the weight of the person during sitting. Furthermore, the inner perimeter of the selected ring provides lateral pressure against the body of the person providing further support and comfort.

19 Claims, 3 Drawing Sheets

(56) References Cited

U.S. PATENT DOCUMENTS

D284,436 S * 7/1986 Hodges ..... D6/596
4,912,788 A * 4/1990 Lonardo ..... A61G 7/05723 297/230.13
D322,301 S * 12/1991 Harris ..... D12/316
5,133,096 A * 7/1992 Neumann ..... A47C 27/001 5/702
5,144,705 A * 9/1992 Rogers ..... A61B 5/1036 5/654
5,171,209 A * 12/1992 Gamba ..... A47C 7/425 602/13
5,282,286 A * 2/1994 MacLeish ..... A47C 4/54 297/469
5,414,884 A * 5/1995 Mackenzie ..... A47C 7/022 297/284.1
D372,829 S * 8/1996 Sircy ..... 5/653
6,082,824 A * 7/2000 Chow ..... A47C 7/022 297/452.22
D429,592 S * 8/2000 Dohan ..... D6/601
6,125,486 A * 10/2000 Rabon ..... A47C 4/54 297/452.41
6,142,573 A * 11/2000 Harding ..... A47C 7/022 297/452.25
6,367,106 B1 * 4/2002 Gronsman ..... A47C 4/54 5/655.3
D496,087 S * 9/2004 Peterson ..... D21/803
6,820,938 B2 * 11/2004 Barrett ..... A47C 7/022 297/4
D509,693 S * 9/2005 Wiltberger ..... D6/601
D628,298 S * 11/2010 Rubio ..... D24/183
8,321,979 B2 * 12/2012 Goodwin ..... A47C 7/021 5/652
8,365,329 B1 * 2/2013 Barsosky ..... A47D 13/083 5/632
9,332,850 B2 5/2016 Krishtul
9,723,928 B2 * 8/2017 Krishtul ..... A47C 7/022
9,763,521 B2 * 9/2017 Krishtul ..... A47C 7/022
2001/0013146 A1 * 8/2001 Wempe ..... A47C 7/022 5/654
2002/0175553 A1 * 11/2002 Steifensand ..... A47C 3/00 297/452.22
2003/0121103 A1 * 7/2003 Wempe ..... A47C 7/022 5/654
2006/0103225 A1 * 5/2006 Kim ..... A47C 7/022 297/452.26
2006/0185093 A1 * 8/2006 Yu ..... A47C 7/021 5/653
2007/0089240 A1 * 4/2007 Dazzi ..... A47C 20/026 5/630
2007/0236074 A1 * 10/2007 Rodriquez, Jr. ..... A47C 7/021 297/452.41
2008/0216245 A1 * 9/2008 Liners ..... A47C 4/52 5/654
2013/0009441 A1 * 1/2013 Carmichael, IV ..... A47C 7/02 297/451.2
2014/0259426 A1 * 9/2014 Pearce ..... B68G 7/00 5/653
2015/0108802 A1 * 4/2015 Krishtul ..... A47C 7/022 297/283.1
2017/0000263 A1 * 1/2017 Krishtul ..... A47C 7/022
2017/0000264 A1 * 1/2017 Krishtul ..... A47C 7/022

* cited by examiner

ERGONOMIC SEAT CUSHION

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal and domestic items including furniture, more specifically, a seat cushion.

SUMMARY OF INVENTION

The ergonomic seat cushion is a cushion that is adapted for use with a person. The person is further defined with a buttocks and a coccyx. The buttock is further defined with a left buttock and a right buttock. The ergonomic seat cushion is adapted to receive the buttocks and coccyx in such a manner that the person is able to sit comfortably for extended periods of time without putting pressure on the buttocks and the coccyx. The ergonomic seat cushion comprises a plurality of rings and an upholstery. The upholstery covers the plurality of rings. As shown most clearly in FIG. 3, the centers of each of the plurality of rings form a straight center line. When the person sits on the ergonomic seat cushion, the coccyx settles into the center ring of the plurality of rings while the left buttock and the right buttock settle into the left ring and the right ring respectively. The location of the aperture within each ring selected from the plurality of rings suspends a body part selected from the group consisting of the left buttock, the right buttock, or the coccyx. The selected body part is suspended by the selected ring above the supporting surface upon which the ergonomic seat cushion is placed. This suspension relieves the selected body part from carrying the weight of the person during sitting. Furthermore, the inner perimeter of the selected ring provides lateral (i.e. perpendicular to the vertical direction) pressure against the body of the person providing further support and comfort.

These together with additional objects, features and advantages of the ergonomic seat cushion will be readily apparent to those of ordinary skill in the art upon reading the following detailed description of the presently preferred, but nonetheless illustrative, embodiments when taken in conjunction with the accompanying drawings.

In this respect, before explaining the current embodiments of the ergonomic seat cushion in detail, it is to be understood that the ergonomic seat cushion is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the ergonomic seat cushion.

It is therefore important that the claims be regarded as including such equivalent construction insofar as they do not depart from the spirit and scope of the ergonomic seat cushion. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
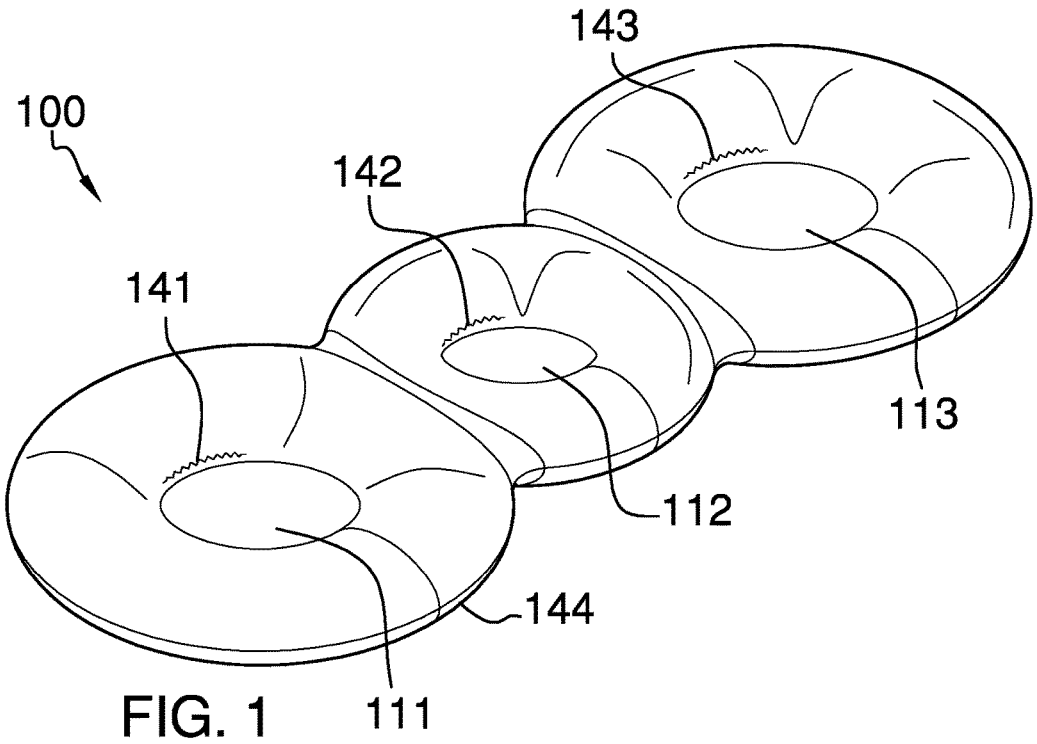
FIG. 1 is a perspective view of an embodiment of the disclosure.
Figure 2:
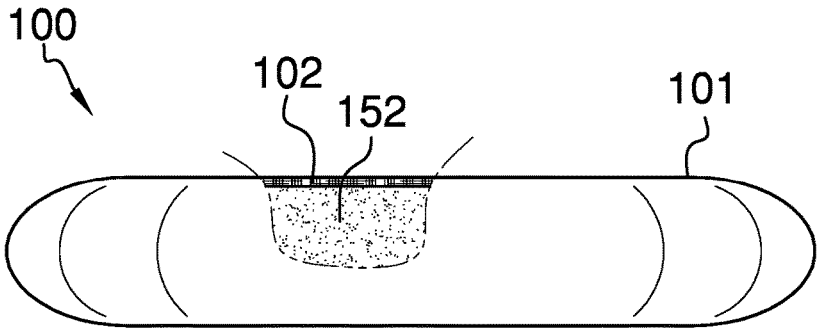
FIG. 2 is an end view of an embodiment of the disclosure.
Figure 3:
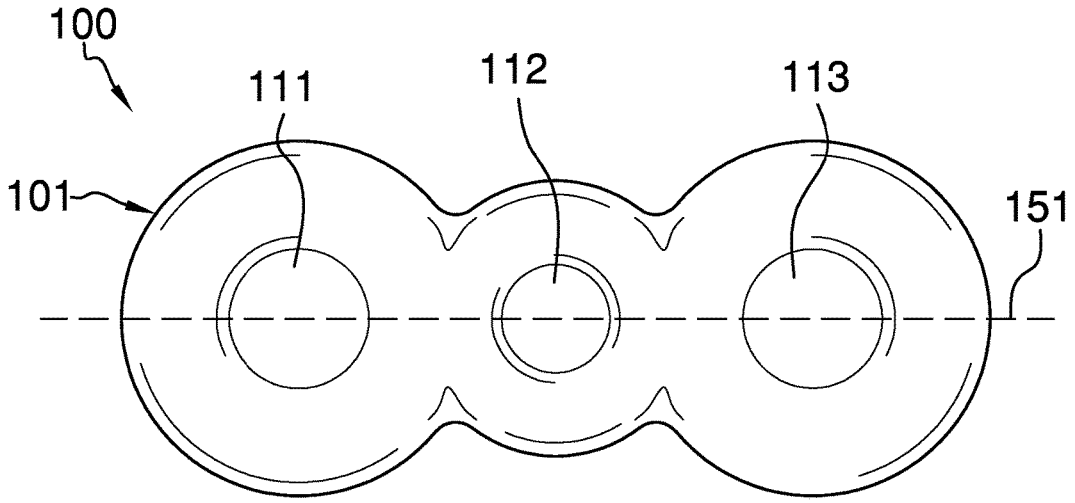
FIG. 3 is a bottom view of an embodiment of the disclosure.
Figure 4:
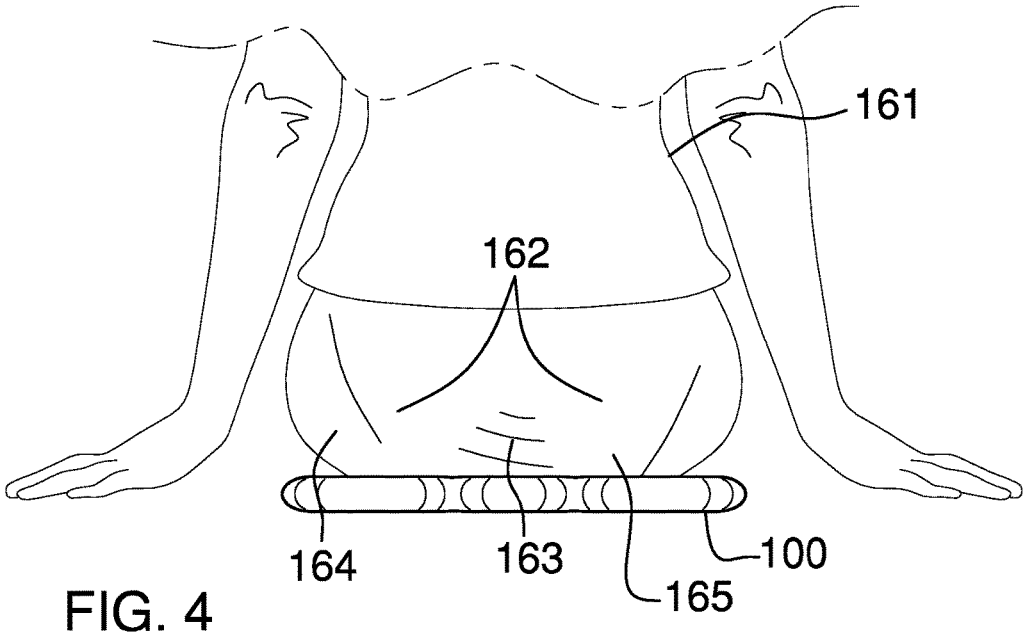
FIG. 4 is an in use view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 5.

The ergonomic seat cushion 100 (hereinafter invention) is a cushion that is adapted for use with a person 161. The person 161 refers to the individual that will sit on the invention 100. The person 161 is further defined with a buttocks 162 and a coccyx 163. The buttocks 162 is further defined with a left buttock 164 and a right buttock 165. The left buttock 164 refers to the buttock on the left side of the person 161. The right buttock 165 refers to the buttock on the right side of the person 161. The invention 100 is adapted to receive the buttocks 162 and coccyx 163 in such a manner that the person 161 is able to sit comfortably for extended periods of time without putting pressure on the buttocks 162 and the coccyx 163. The invention 100 comprises a plurality of rings 101 and an upholstery 102. The upholstery 102 covers the plurality of rings 101. As shown most clearly in FIG. 3, the centers of each of the plurality of rings 101 form a straight center line 151. When the person 161 sits on the invention 100, the coccyx 163 settles into the center ring 112 of the plurality of rings 101 while the left buttock 164 and the right buttock 165 settle into the left ring 111 and the right ring 113 respectively. The location of the aperture within each ring selected from the plurality of rings 101 suspends a body part selected from the group consisting of the left buttock 164, the right buttock 165, or the coccyx 163. The selected body part is suspended by the selected ring above the supporting surface upon which the invention 100 is placed. This suspension relieves the selected body part from carrying the weight of the person 161 during sitting. Furthermore, the inner perimeter of the selected ring provides lateral (i.e. perpendicular to the vertical direction) pressure against the body of the person 161 providing further support and comfort.

The plurality of rings 101 is a semi-rigid structure that is formed in the shape of a three hole torus. The semi-rigid structure of the plurality of rings 101 is elastic in nature.

In the first potential embodiment of the disclosure, the plurality of rings 101 is formed as a single object from a viscoelastic polyurethane foam 152. The plurality of rings 101 is further defined with a left ring 111, a center ring 112, and a right ring 113.

The left ring 111 is one of the three apertures formed within the plurality of rings 101. The center of the left ring 111 is located on the center line 151. The center ring 112 is one of the three apertures formed within the plurality of rings 101. The center of the center ring 112 is located on the center line 151. The right ring 113 is one of the three apertures formed within the plurality of rings 101. The center of the right ring 113 is located on the center line 151. The center line 151 is a straight line.

When the invention 100 is in use, the left ring 111 is located underneath the left buttock 164. The center ring 112 is located underneath the coccyx 163. The right ring 113 is located underneath the right buttock 165.

The upholstery 102 is a structure formed from sheeting that is used to enclose the plurality of rings 101 for the purposes of: 1) decoration; and, 2) protecting the plurality of rings 101 from damage. The upholstery 102 is formed such that the rings within the three ring torus that forms the plurality of rings 101 are accessible from the exterior of the invention 100. The upholstery 102 comprises a first sheeting 131 and a second sheeting 132.

Figure 5:
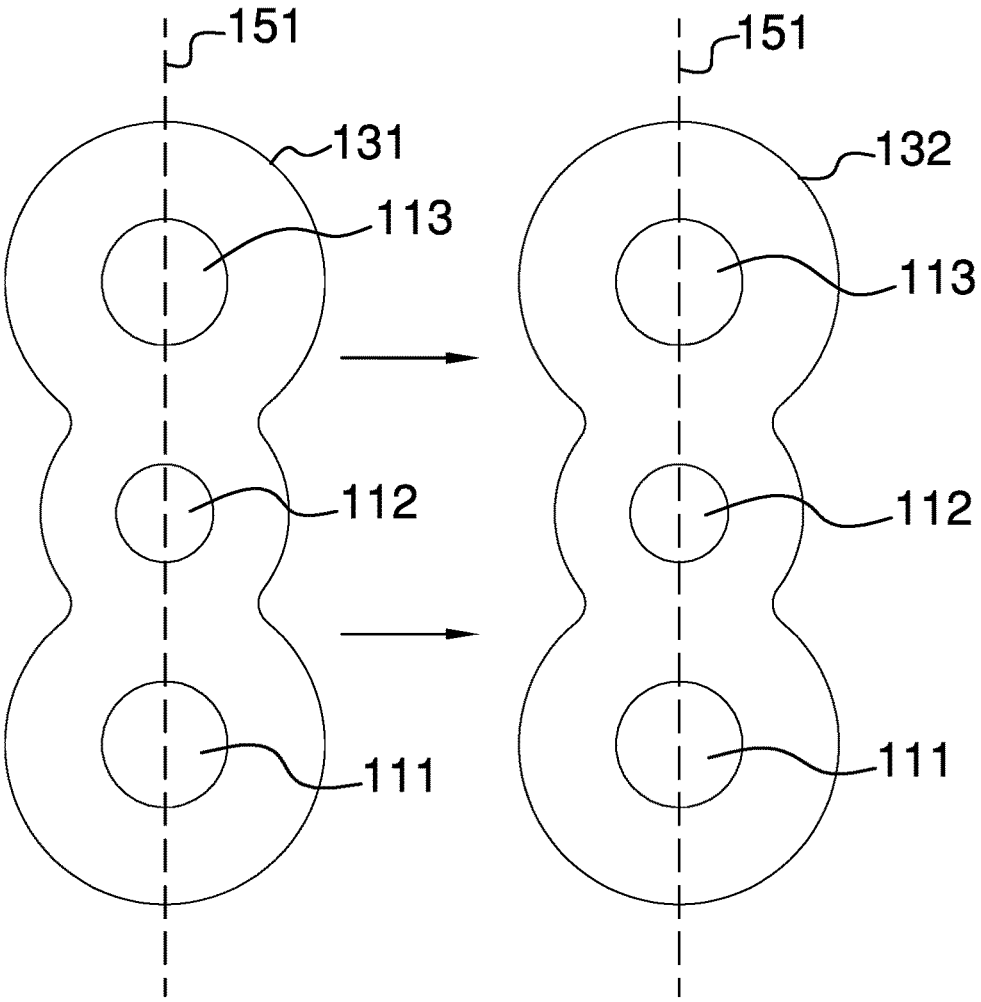
FIG. 5 is a detail view of an embodiment of the disclosure.

As shown most clearly in FIG. 5, the first sheeting 131 is a sheeting that is cut into the shape of a first three hole annulus that is matched to the shape of the plurality of rings 101. The first sheeting 131 further comprises a left ring 111 that corresponds to the left ring 111 of the plurality of rings 101. The first sheeting 131 further comprises a center ring 112 that corresponds to the center ring 112 of the plurality of rings 101. The first sheeting 131 further comprises a right ring 113 that corresponds to the right ring 113 of the plurality of rings 101.

The second sheeting 132 is a sheeting that is cut into the shape of a second three hole annulus that is matched to the shape of the plurality of rings 101. The second sheeting 132 further comprises a left ring 111 that corresponds to the left ring 111 of the plurality of rings 101. The second sheeting 132 further comprises a center ring 112 that corresponds to the center ring 112 of the plurality of rings 101. The second sheeting 132 further comprises a right ring 113 that corresponds to the right ring 113 of the plurality of rings 101. The second sheeting 132 is formed from the same textile material as the first sheeting 131.

In the first potential embodiment of the disclosure, the first sheeting 131 is formed from a textile material.

The invention 100 further comprises a first seam 141, a second seam 142, a third seam 143, and a fourth seam 144. The invention 100 is formed by placing the plurality of rings 101 between the first sheeting 131 and the second sheeting 132 such that: 1) the left ring 111 of the first sheeting 131 and the left ring 111 of the second sheeting 132 aligns with the left ring 111 of the plurality of rings 101; 2) the center ring 112 of the first sheeting 131 and the center ring 112 of the second sheeting 132 aligns with the center ring 112 of the plurality of rings 101; and, 3) the right ring 113 of the first sheeting 131 and the right ring 113 of the second sheeting 132 aligns with the right ring 113 of the plurality of rings 101. The first sheeting 131 and the second sheeting 132 are then joined using the first seam 141, the second seam 142, the third seam 143, and the fourth seam 144.

As shown most clearly in FIG. 1, the fourth seam 144 joins the outer perimeter of the first sheeting 131 to the outer perimeter of the second sheeting 132. The first seam 141 joins the circumference of the left ring 111 of the first sheeting 131 to the circumference of the left ring 111 of the second sheeting 132. The second seam 142 joins the circumference of the center ring 112 of the first sheeting 131 to the circumference of the center ring 112 of the second sheeting 132. The third seam 143 joins the circumference of the right ring 113 of the first sheeting 131 to the circumference of the right ring 113 of the second sheeting 132.

In the first potential embodiment of the disclosure, the first seam 141 is a sewn seam. The second seam 142 is a sewn seam. The third seam 143 is a sewn seam. The fourth seam 144 is a sewn seam.

To use the invention 100, the person 161 sits on the invention 100 as though it were a normal seat cushion.

The following definitions were used in this disclosure:

Annulus: As used in this disclosure, an annulus is a two dimensional torus like structure.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Cushion: As used in this disclosure a cushion is a pad or pillow formed from soft material that is used for resting, sleeping, or reclining.

Cylinder: As used in this disclosure, a cylinder is a geometric structure defined by two identical flat and parallel ends, also commonly referred to as bases, which are circular in shape and connected with a single curved surface, referred to in this disclosure as the face. The cross section of the cylinder remains the same from one end to another. The axis of the cylinder is formed by the straight line that connects the center of each of the two identical flat and parallel ends of the cylinder. In this disclosure, the term cylinder specifically means a right cylinder which is defined as a cylinder wherein the curved surface perpendicularly intersects with the two identical flat and parallel ends.

Diameter: As used in this disclosure, a diameter of an object is a straight line segment that passes through the center of an object. The line segment of the diameter is terminated at the perimeter or boundary of the object through which the line segment of the diameter runs.

Disk: As used in this disclosure, a disk is a cylindrically shaped object that is flat in appearance.

Elastic: As used in this disclosure, an elastic is a material or object that deforms when a force is applied to it and that is able to return to its original shape after the force is removed. A material that exhibits these qualities is also referred to as an elastomeric material.

Exterior: As used in this disclosure, the exterior is use as a relational term that implies that an object is not contained within the boundary of a structure or a space.

Foam: As used in this disclosure, foam is a mass of gas filled spaces, commonly referred to as bubbles, which can be formed: 1) on or in a liquid or gel; or, 2) in a solid material.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inner Perimeter: As used in this disclosure, the term inner perimeter is used in the same way that a plumber would refer to the inner diameter of a pipe.

Interior: As used in this disclosure, the interior is use as a relational term that implies that an object is contained within the boundary of a structure or a space.

Outer Perimeter: As used in this disclosure, the term outer perimeter is used in the same way that a plumber would refer to the outer diameter of a pipe.

Pad: As used in this disclosure, a pad is a mass of soft material used as a filling or for protection against damage or injury. Commonly used padding materials include, but are not limited to, polyurethane foam, a polyester fill often referred to as fiberfill or polystyrene beads often referred to as stuffing beans or as bean bag chair beans.

Perimeter: As used in this disclosure, a perimeter is one or more curved or straight lines that bounds an enclosed area on a plane or surface. The perimeter of a circle is commonly referred to as a circumference.

Ring: As used in this disclosure, a ring is term that is used to describe a flat or plate like structure through which an aperture is formed.

Seam: As used in this disclosure, a seam is a joining of: 1) a first textile to a second textile; 2) a first sheeting to a second sheeting; or, 3) a first textile to a first sheeting. Potential methods to form seams include, but are not limited to, a sewn seam, a heat bonded seam, an ultrasonically bonded seam, or a seam formed using an adhesive.

Semi-Rigid Structure: As used in this disclosure, a semi-rigid structure is a solid structure that is will deform under force before breaking or tearing. A semi-rigid structure may or may not behave in an elastic fashion in that a semi-rigid structure need not return to a relaxed shape.

Sewn Seam: As used in this disclosure, a sewn seam a method of attaching two or more layers of textile, leather, or other material through the use of a thread, a yarn, or a cord that is repeatedly inserted and looped through the two or more layers of textile, leather, or other material.

Sheeting: As used in this disclosure, sheeting is a material, such as a textile, a plastic, or a metal foil, in the form of a thin flexible layer or layers.

Textile: As used in this disclosure, a textile is a material that is woven, knitted, braided or felted. Synonyms in common usage for this definition include fabric and cloth.

Torus: As used in this disclosure, a torus is a three dimensional disk like object that formed with a circular or cylindrical aperture through the three dimensional object. The circular or cylindrical aperture forms a ring or loop like structure. Two or more tori that are merged together are referred to as a N hole torus where N is the number of apertures. In common usage, torus would refer to a one hole torus that is reminiscent of a donut shape.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An ergonomic seat cushion comprising:

a plurality of rings and an upholstery;

wherein the upholstery covers the plurality of rings;

wherein the ergonomic seat cushion is a cushion;

wherein the ergonomic seat cushion is adapted for use with a person defined with a body defined with a buttocks and a coccyx, the buttocks further defined with a left buttock and a right buttock;

wherein the ergonomic seat cushion is adapted to receive the buttocks and the coccyx in such a manner that the person is able to sit without putting pressure on the buttocks and the coccyx;

wherein a ring selected from the plurality of rings is adapted to suspend a body part selected from the group consisting of the left buttock, the right buttock, or the coccyx;

wherein the ring of the plurality of rings is adapted to suspend the body part above a supporting surface upon which the ergonomic seat cushion is placed;

wherein an inner perimeter of the selected ring provides pressure against the body of the person;

wherein the plurality of rings is a semi-rigid structure that is formed in a shape of a three hole torus;

wherein the semi-rigid structure of the plurality of rings is elastic.

2. The ergonomic seat cushion according to claim 1 wherein the plurality of rings is formed as a single object from a viscoelastic polyurethane foam.

3. The ergonomic seat cushion according to claim 2 wherein wherein the plurality of rings is further defined with a left ring, a center ring, and a right ring;

wherein the left ring is one of three apertures formed within the plurality of rings;

wherein the center ring is one of said three apertures formed within the plurality of rings;

wherein the right ring is one of said three apertures formed within the plurality of rings.

4. The ergonomic seat cushion according to claim 3 wherein wherein the center of the left ring is located on a center line;

wherein the center of the center ring is located on the center line;

wherein the center of the right ring is located on the center line;

wherein the center line is a straight line.

5. The ergonomic seat cushion according to claim 4 wherein the upholstery is a structure formed from sheeting that is used to enclose the plurality of rings.

6. The ergonomic seat cushion according to claim 5 wherein the upholstery is a structure formed from sheeting that is used to enclose the plurality of rings.

7. The ergonomic seat cushion according to claim 6 wherein the upholstery is formed such that the rings within the three ring torus that forms the plurality of rings are accessible from the exterior of the ergonomic seat cushion.

8. The ergonomic seat cushion according to claim 7 wherein the upholstery comprises a first sheeting and a second sheeting;

wherein the first sheeting is joined to the second sheeting.

9. The ergonomic seat cushion according to claim 8 wherein the first sheeting is a sheeting that is cut into the shape of a first three hole annulus that is matched to the shape of the plurality of rings;

wherein the second sheeting is a sheeting that is cut into the shape of a second three hole annulus that is matched to the shape of the plurality of rings.

10. The ergonomic seat cushion according to claim 9 wherein the first sheeting further comprises a first left opening that corresponds to the left ring of the plurality of rings;

wherein the first sheeting further comprises a first center opening that corresponds to the center ring of the plurality of rings;

wherein the first sheeting further comprises a first right opening that corresponds to the right ring of the plurality of rings;

wherein the second sheeting further comprises a second left opening that corresponds to the left ring of the plurality of rings;

wherein the second sheeting further comprises a second center opening that corresponds to the center ring of the plurality of rings;

wherein the second sheeting further comprises a second right opening that corresponds to the right ring of the plurality of rings.

11. The ergonomic seat cushion according to claim 10 wherein the first sheeting is formed from a textile material;

wherein the second sheeting is formed from the textile material of the first sheeting.

12. The ergonomic seat cushion according to claim 11 wherein the ergonomic seat cushion further comprises a first seam, a second seam, a third seam, and a fourth seam;

wherein the first sheeting and the second sheeting are joined using the first seam, the second seam, the third seam, and the fourth seam.

13. The ergonomic seat cushion according to claim 12 wherein the ergonomic seat cushion is formed by placing the plurality of rings between the first sheeting and the second sheeting such that the first left opening of the first sheeting and the second left opening of the second sheeting aligns with the left ring of the plurality of rings;

wherein the ergonomic seat cushion is formed by placing the plurality of rings between the first sheeting and the second sheeting such that the first center opening of the first sheeting and the second center opening of the second sheeting aligns with the center ring of the plurality of rings;

wherein the ergonomic seat cushion is formed by placing the plurality of rings between the first sheeting and the second sheeting such that the first right opening of the first sheeting and the right opening of the second sheeting aligns with the right ring of the plurality of rings.

14. The ergonomic seat cushion according to claim 13 wherein the fourth seam joins an outer perimeter of the first sheeting to an outer perimeter of the second sheeting;

wherein the first seam joins the circumference of the first left opening of the first sheeting to the circumference of the second left opening of the second sheeting;

wherein the second seam joins the circumference of the first center opening of the first sheeting to the circumference of the second center opening of the second sheeting;

wherein the third seam joins the circumference of the first right opening of the first sheeting to the circumference of the second right opening of the second sheeting.

15. The ergonomic seat cushion according to claim 14 wherein the first seam is a sewn seam;

wherein the second seam is a sewn seam;

wherein the third seam is a sewn seam;

wherein the fourth seam is a sewn seam.

16. The ergonomic seat cushion according to claim 1 wherein the upholstery comprises a first sheeting and a second sheeting;

wherein the first sheeting is joined to the second sheeting;

wherein the first sheeting is a sheeting that is cut into the shape of a first three hole annulus that is matched to the shape of the plurality of rings;

wherein the second sheeting is a sheeting that is cut into the shape of a second three hole annulus that is matched to the shape of the plurality of rings;

wherein the first sheeting further comprises a first left opening;

wherein the first sheeting further comprises a first center opening;

wherein the first sheeting further comprises a first right opening;

wherein the second sheeting further comprises a second left opening;

wherein the second sheeting further comprises a second center opening;

wherein the second sheeting further comprises a second right opening; wherein the first sheeting is formed from a textile material;

wherein the second sheeting is formed from the textile material of the first sheeting.

17. The ergonomic seat cushion according to claim 16 wherein wherein the plurality of rings is a semi-rigid structure that is formed in the shape of a three hole torus;

wherein the semi-rigid structure of the plurality of rings is elastic in nature;

wherein the plurality of rings is formed as a single object;

wherein the plurality of rings is further defined with a left ring, a center ring, and a right ring;

wherein the left ring is formed within the plurality of rings;

wherein the center ring is formed within the plurality of rings;

wherein the right ring is formed within the plurality of rings;

wherein the left ring corresponds to the first left opening;

wherein the center ring corresponds to the first center opening;

wherein the right ring corresponds to the first right opening;

wherein the left ring corresponds to the second left opening;

wherein the center ring corresponds to the second center opening;

wherein the right ring corresponds to the second right opening;

wherein the center of the left ring is located on a center line;

wherein the center of the center ring is located on the center line;

wherein the center of the right ring is located on the center line;

wherein the center line is a straight line.

18. The ergonomic seat cushion according to claim 17 wherein the ergonomic seat cushion further comprises a first seam, a second seam, a third seam, and a fourth seam;

wherein the first sheeting and the second sheeting are joined using the first seam, the second seam, the third seam, and the fourth seam.

19. The ergonomic seat cushion according to claim 18 wherein the ergonomic seat cushion is formed by placing the plurality of rings between the first sheeting and the second sheeting such that the first left opening of the first sheeting and the second left opening of the second sheeting aligns with the left ring of the plurality of rings;

wherein the ergonomic seat cushion is formed by placing the plurality of rings between the first sheeting and the second sheeting such that the first center opening of the first sheeting and the second center opening of the second sheeting aligns with the center ring of the plurality of rings;

wherein the ergonomic seat cushion is formed by placing the plurality of rings between the first sheeting and the second sheeting such that the first right opening of the first sheeting and the right opening of the second sheeting aligns with the right ring of the plurality of rings;

wherein the fourth seam joins an outer perimeter of the first sheeting to an outer perimeter of the second sheeting;

wherein the first seam joins the circumference of the first left opening of the first sheeting to the circumference of the second left opening of the second sheeting;

wherein the second seam joins the circumference of the first center opening of the first sheeting to the circumference of the second center opening of the second sheeting;

wherein the third seam joins the circumference of the first right opening of the first sheeting to the circumference of the second right opening of the second sheeting;

wherein the first seam is a sewn seam;

wherein the second seam is a sewn seam;

wherein the third seam is a sewn seam;

wherein the fourth seam is a sewn seam.

* * * * *